US009026009B2

(12) United States Patent
Takahashi et al.

(10) Patent No.: US 9,026,009 B2
(45) Date of Patent: May 5, 2015

(54) TONER CONTAINER AND IMAGE FORMING APPARATUS USING SAME

(75) Inventors: Masanao Takahashi, Tokyo (JP); Takashi Munakata, Kanagawa (JP); Aya Masuda, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 288 days.

(21) Appl. No.: 13/419,941

(22) Filed: Mar. 14, 2012

(65) Prior Publication Data

US 2012/0237269 A1 Sep. 20, 2012

(30) Foreign Application Priority Data

Mar. 18, 2011 (JP) ..... 2011-061219

(51) Int. Cl.
*G03G 15/08* (2006.01)

(52) U.S. Cl.
CPC .... *G03G 15/0867* (2013.01); *G03G 2221/1846* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,786,495 | A * | 3/1957 | Benson | 141/370 |
| 4,990,964 | A * | 2/1991 | Kraehn | 399/261 |
| 7,822,371 | B2 | 10/2010 | Taguchi et al. | |
| 2009/0200261 | A1* | 8/2009 | Sasaki et al. | 215/396 |
| 2010/0316414 | A1* | 12/2010 | Saito et al. | 399/258 |
| 2011/0243579 | A1 | 10/2011 | Oshikawa et al. | |
| 2011/0305485 | A1 | 12/2011 | Oshikawa et al. | |
| 2011/0311281 | A1* | 12/2011 | Ohyama et al. | 399/262 |

FOREIGN PATENT DOCUMENTS

| | | |
|---|---|---|
| JP | 2000-132067 | 5/2000 |
| JP | 2000-305346 | 11/2000 |
| JP | 2001-222158 | 8/2001 |
| JP | 2006-8187 | 1/2006 |
| JP | 2009-294406 | 12/2009 |

OTHER PUBLICATIONS

Office Action issued Nov. 13, 2014 in Japanese Patent Application No. 2011-061219.

* cited by examiner

*Primary Examiner* — David Gray
*Assistant Examiner* — Victor Verbitsky
(74) *Attorney, Agent, or Firm* — Oblon, McClelland, Maier & Neustadt, L.L.P.

(57) ABSTRACT

A toner container for containing toner, removably installable into an apparatus body, includes a container body in which an opening for receiving toner therein or discharging toner therefrom is formed and a handle forming a front end portion of the toner container when the toner container is installed in the apparatus body, the handle having a front face inclined relative to a center axis (L) of the container body.

16 Claims, 7 Drawing Sheets

TONER CONTAINER AND IMAGE FORMING APPARATUS USING SAME

CROSS-REFERENCE TO RELATED APPLICATION

This patent application is based on and claims priority pursuant to 35 U.S.C. §119 to Japanese Patent Application No. 2011-061219, filed on Mar. 18, 2011, in the Japan Patent Office, the entire disclosure of which is hereby incorporated by reference herein.

FIELD OF THE INVENTION

The present invention generally relates to a toner container for containing toner supplied or collected from an apparatus body, and an electrophotographic image forming apparatus such as a copier, a printer, a facsimile machine, or a multi-function machine capable of at least two of these functions, that includes a toner container.

BACKGROUND OF THE INVENTION

Electrophotographic image forming apparatuses, such as facsimile machines or printers, typically include a toner container for containing toner supplied to an image forming unit or waste toner (used toner) collected from the image forming unit. There are various types of toner containers different in shape. For example, cylindrical toner containers provided with a handle are proposed for ease of handling of the toner container.

In toner containers for supplied toner, typically an opening (toner outlet) connected to a toner inlet of a toner supply device is provided on a side face of a container body, while, in toner containers for waste toner, an opening (toner inlet) through which waste toner flows in is provided on a side face of a container body. Such openings are often disposed in an end portion of the container body on either the back side (distal side) or front side (proximal) of toner container is on the front side of the apparatus.

For example, an insertion opening for replacement of the toner container is formed in the front plate of the housing of the image forming apparatus. To remove the toner container from the apparatus, users can grip the handle of the toner container with one hand and pull out the toner container through the insertion opening, while supporting the container body with the other hand. Then, the toner container is placed horizontally on the floor or nearby table temporarily. To insert a new toner container into the apparatus body, users can grip the handle of the toner container with one hand and supports the container body with the other hand. Then, the removed toner container is collected in a collecting box or the like. It is to be noted that, toner containers for supplied toner are generally designed to be placed horizontally with the opening thereof faced up, and projections serving as legs are formed on a side face of the toner container opposite the opening (toner supply device).

Although the frequency of replacement of toner containers generally depends on the number of output sheets on which images have been formed, consumption of toner per sheet dramatically increases in the case of so-called solid images such as photographs whose printing ratio is high. Accordingly, replacement frequency of toner containers is high particularly in image forming apparatuses for forming a large amount of solid image, such as for use in the field of production printing. The increase in replacement frequency of toner containers is high can result in increases in the possibility that users or service persons place the toner container temporarily on the top face of the image forming apparatus or place the toner container vertically and directly on the nearby floor. The opening, namely, toner inlet or outlet, formed in (the toner supply device of) the toner container is generally opened or closed with a valve disc, and there may be some toner remaining adjacent to the opening. In case that the toner container placed vertically falls unexpectedly, the toner remaining adjacent to the opening might leak and scatter on the floor. Moreover, the fallen toner container can be damaged.

In view of the foregoing, for example, JP-2009-294406-A proposes providing a projection on a face of the toner container that is on the bottom when the toner container is placed vertically, thereby preventing the toner container from being placed vertically.

It, however, is still possible that the toner container falls with the opening faced down if the toner container is put on an unexpected plane, such as, an uneven surface. Referring to FIG. 1, when a toner container T having a projection P on a bottom face thereof in FIG. 1 is placed vertically on a stepped surface S, the projection P does not hinder the user from placing the toner container T vertically. If the user touches the toner container T carelessly, the toner container T might fall, causing scattering of toner from an opening M. Additionally, when the toner container T is placed on a thick carpet C, the projection P can sink in the carpet C, thus failing to prevent the user from placing the toner container T vertically.

BRIEF SUMMARY OF THE INVENTION

In view of the foregoing, one embodiment of the present invention provides a toner container removably installable into an apparatus body for containing toner supplied to or collected from the apparatus body. The toner container includes a container body in which an opening for receiving toner therein or discharging toner therefrom is formed, and a handle positioned on a front side of the apparatus body when the toner container is installed in the apparatus body. A front face of the handle is inclined relative to a center axis (L) of the container body.

In another embodiment, an image forming apparatus includes an image bearer, an image forming unit to form a toner image on the image bearer, and the above-described toner container.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
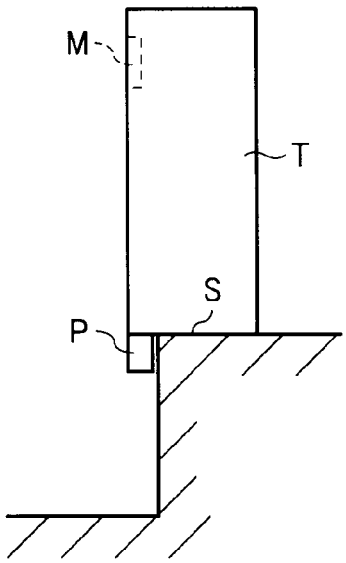
FIG. 1 RELATED ART
FIG. 1 is a side view of a related-art toner container placed vertically on a surface having a difference in height.
Figure 2:
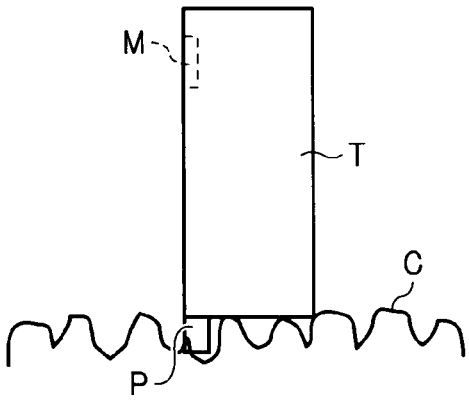
FIG. 2 RELATED ART
FIG. 2 is a side view of a related-art toner container placed vertically on a rug or carpet.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 3:
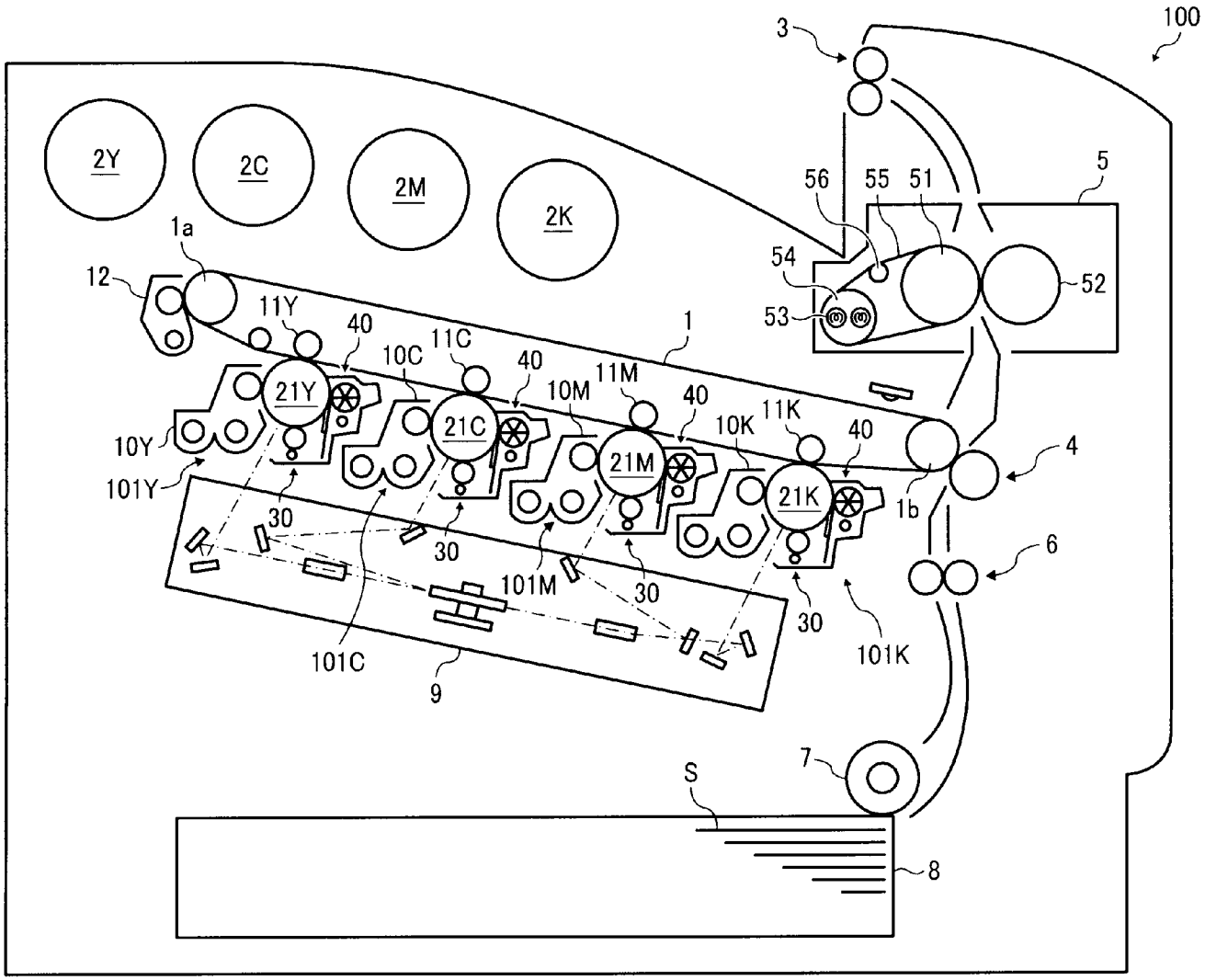
FIG. 3 is a schematic diagram of an image forming apparatus to which a toner container according to an embodiment is installed.

Referring now to the drawings, wherein like reference numerals designate identical or corresponding parts throughout the several views thereof, and particularly to FIG. 3, a multicolor image forming apparatus according to an embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

[Image Forming Apparatus]

FIG. 3 is a schematic diagram of an image forming apparatus 100 to which a toner container according to an embodiment of the present invention is installed.

The image forming apparatus 100 shown in FIG. 3 may be, for example, a multicolor laser printer, and includes a tandem image forming unit in which four image forming units 101Y, 101C, 101M, and 101K are arranged at regular intervals. It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Each of the image forming units 101 includes a photoreceptor (photoreceptor drum) 21, serving as an image bearer, a mechanism to form latent images on the photoreceptor 21, a development device 10 to develop the latent image with toner into a toner image, and a cleaning unit 40 to clean the surface of the photoreceptor 21. The mechanism to form latent images includes a optical writing unit 9 and a charging unit 30. The mechanism and the development device 10 together form an image forming unit.

In an upper portion of the apparatus, toner containers 2Y, 2C, 2M, and 2K are provided. The four toner containers 2Y, 2C, 2M, and 2K are horizontally inserted into the apparatus body from respective insertion openings formed in the apparatus body. The toner containers 2Y, 2C, 2M, and 2K contain yellow, cyan, magenta, and black toners, respectively. The toner is supplied from the toner container 2 through a conveyance path (i.e., conveyance tube) to the development device 10 as required.

The optical writing unit 9, serving as a latent image forming unit, is disposed beneath the tandem image forming unit. The optical writing unit 9 includes a light source, a polygon mirror, an f-θ lens, and reflection mirrors, and is configured to direct a laser beam onto the surface of the photoreceptor 21 according to image data.

Above the tandem image forming unit, an intermediate transfer belt 1 that is an endless belt is provided. The intermediate transfer belt 1 is looped around support rollers 1*a* and 1*b*. The support roller 1*a* serves as a driving roller, and a driving motor serving as a drive source is connected to a rotary shaft of the support roller 1*a*. When the driving motor is driven, the intermediate transfer belt 1 looped around the support rollers 1*a* and 1*b* rotates counterclockwise in FIG. 1. As the intermediate transfer belt 1 rotates, the support roller 1*b* also rotates. Additionally, primary-transfer devices 11Y, 11C, 11M, and 11K are provided inside the loop of the intermediate transfer belt 1 to transfer the toner images from the photoreceptors 21Y, 21C, 21M, and 21K, respectively, onto the intermediate transfer belt 1.

It is to be noted that reference numeral 12 shown in FIG. 1 represents a belt cleaning unit.

Additionally, a secondary-transfer roller 4 is provided downstream from the primary-transfer devices 11 in the direction of rotation of the intermediate transfer belt 1. The secondary-transfer roller 4 faces the support roller 1*b* via the intermediate transfer belt 1. The support roller 1*b* presses against the secondary-transfer roller 4 via the intermediate transfer belt 1. Additionally, a sheet cassette 8 for containing sheets S of recording media, a feed roller 7, and a pair of registration rollers 6 are provided upstream from the secondary-transfer roller 4 in the direction in which the sheet S is transported (hereinafter "sheet conveyance direction"). Further, a fixing device 5 as well as a pair of discharged rollers 3 is provided downstream from the secondary-transfer roller 4 in the sheet conveyance direction. The fixing device 5 fixes the toner image on the sheet S with heat and pressure.

The fixing device 5 includes a fixing roller 51 serving as a fixing member, a heating roller 54 serving as a heating member, a fixing belt 55, a pressure roller 52 serving as a pressure member pressed against a surface of the fixing belt 55, and a tensioner 56 to make the fixing belt 55 taut. The fixing belt 55 is rotatably looped around at least the fixing roller 51 and the heating roller 54. The heating roller 54 includes a heat source 53, and a temperature controller keeps the surface temperature of the fixing roller 51 at a predetermined temperature suitable for image fixing.

The image forming operation performed in the above-described image forming apparatus 100 is described below.

In each image forming unit 101, the photoreceptor 21 is rotated, and the charging unit 30 charges the surface of the photoreceptor 21 uniformly. Then, the optical writing unit 9 directs writing light (laser beams) onto the surfaces of the photoreceptors 21 according to image data, thus forming electrostatic latent images on the respective photoreceptors 21. Then, the development device 10 in each image forming unit 101 develops the latent image into a toner image, and thus magenta, cyan, yellow, and black single-color toner images are formed on the respective photoreceptors 21.

As the support roller (driving roller) 1*a* rotates, driven by the driving motor, the intermediate transfer belt 1, the support roller 1*b*, and the secondary-transfer roller 4 are driven to rotate. Then, the primary-transfer devices 11 sequentially transfer the toner images from the respective photoreceptors 21 and superimpose the toner images one on top of another on the intermediate transfer belt 1. Thus, a multicolor toner image is formed on the intermediate transfer belt 1. After image transfer, the cleaning units 40 remove toner remaining on the respective photoreceptors 21 as a preparation for subsequent image formation.

In parallel to image formation, the feed roller 7 feeds the sheet S from the sheet cassette 8 toward the registration rollers 6. The registration rollers 6 stop the sheet S temporarily and then forward the sheet S to a secondary-transfer position, where the secondary-transfer roller 4 faces the intermediate transfer belt 1, timed to coincide with image formation. The secondary-transfer roller 4 presses against the intermediate transfer belt 1 via the sheet S, thus forming a secondary-transfer nip therebetween. Then, the secondary-transfer roller 4 secondarily transfers the toner image from the intermediate transfer belt 1 onto the sheet S, after which the sheet S is conveyed to the fixing device 5.

In the fixing device 5, the pressure roller 52 presses against the fixing roller 51, together forming a fixing nip. The sheet S is clamped in the fixing nip, and the toner image is fixed thereon with heat and pressured. Subsequently, the sheet S is discharged by the discharge rollers 3 outside the apparatus. Meanwhile, the belt cleaning unit 12 removes the toner remaining on the intermediate transfer belt 1 after the image is transferred therefrom in preparation for subsequent image formation by the tandem image forming unit.

[Toner Container]

Next, toner containers 2 are described below with reference to FIGS. 4 through 8C.

Figure 4:
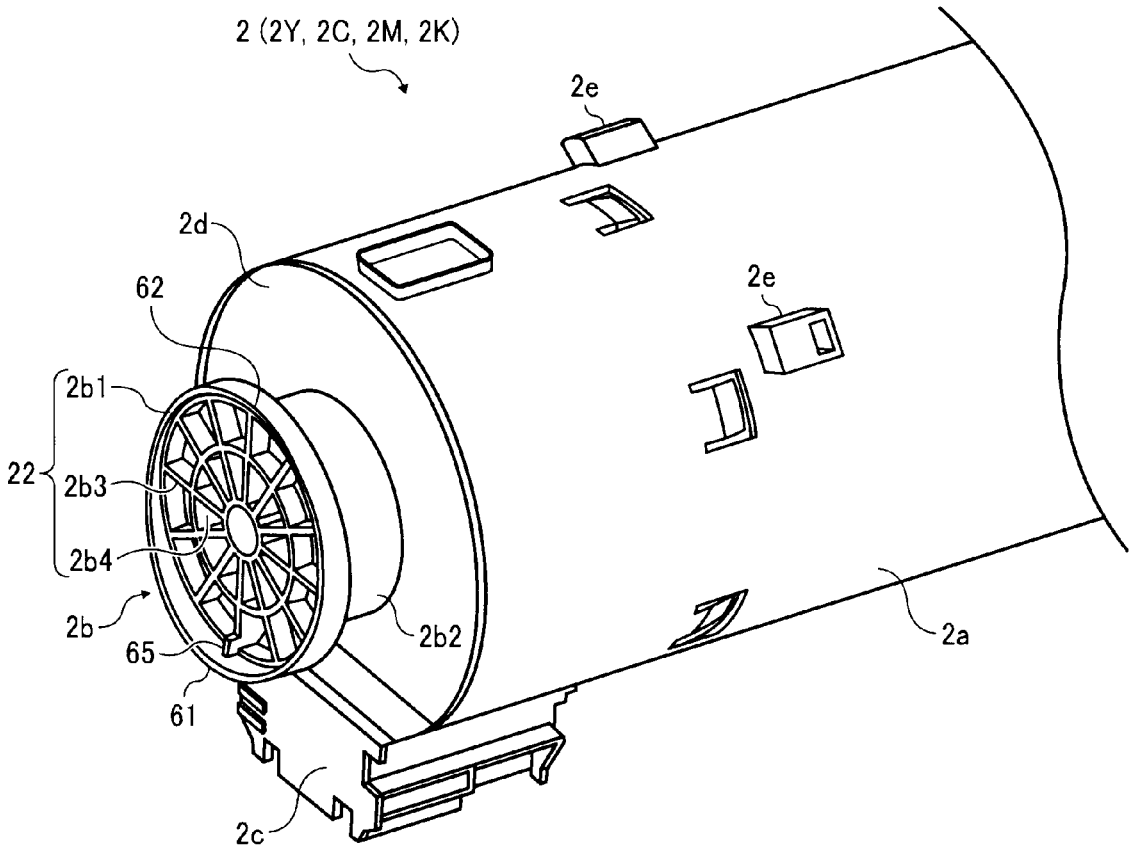
FIG. 4 is a perspective view of a toner container according to an embodiment.
Figure 5A:
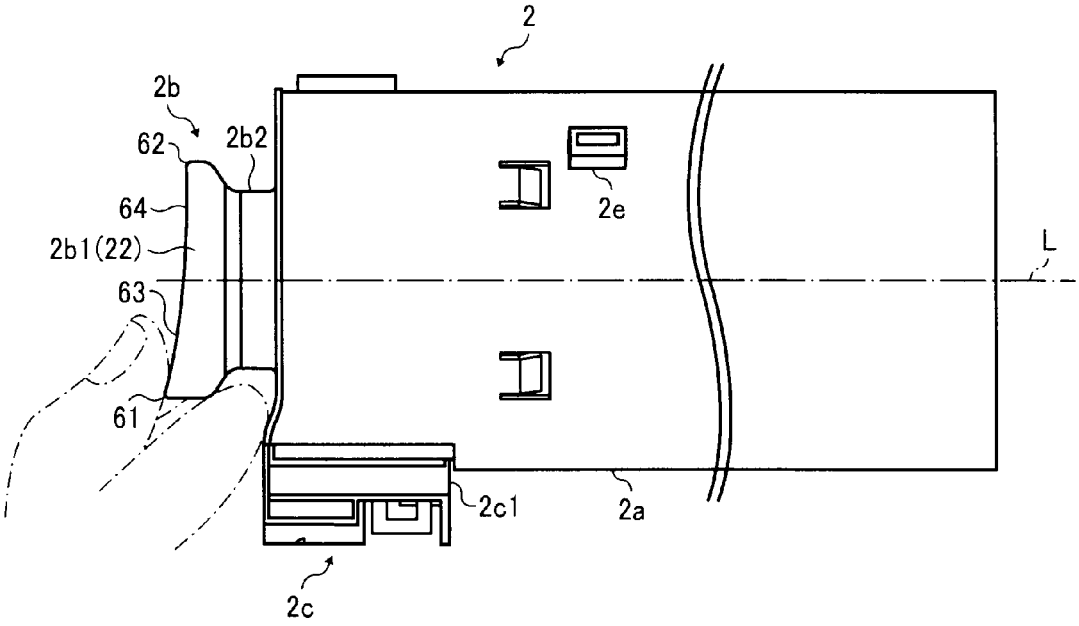
FIG. 5A is a side view of the toner container.

The toner containers 2 can be made of resin, for example. In the present embodiment, all the toner containers 2 have an identical or similar shape. As shown in FIGS. 4 and 5A, the toner container 2 includes a cylindrical container body 2*a* (i.e., bottle body), a handle 2*b* provided on an edge face (front face) 2*d* of the container body 2*a*, and a toner supply device 2*c* provided on a bottom face of the container body 2*a*. The toner supply device 2*c* is positioned on the same side as the handle 2*b* in a longitudinal direction of the toner container 2. That is, the toner supply device 2*c* is disposed in a longitudinal end portion of the container body 2*a*.

It is to be noted that the term "cylindrical" used in this specification is not limited to round columns but also includes polygonal prisms.

The toner containers 2 are horizontally inserted through the respective insertion openings into the apparatus body with the handles 2*b* on the front side (proximal side), that is, the handles 2*b* are trailing ends in the direction of insertion of the toner containers 2. Thus, the handle 2*b* forms a front end portion of the toner container 2 when the toner container 2 is installed in the apparatus body. Then, the handles 2*b* are arranged laterally on the front side of the image forming apparatus 100. With this configuration, users can recognize at a glance that all the toner containers 2 are set in the predetermined insertion openings.

The toner supply device 2*c* includes a mechanism such as a valve disc or shutter to open and close an opening (toner outlet) 2*c*1. For example, the valve disc is movable reciprocally, driven by a driving member provided on the apparatus side. The toner supply device 2*c* is designed to supply a constant amount of toner intermittently from the toner container 2 through the opening 2*c*1 of the toner supply device 2*c* to the apparatus body (i.e., development device 10).

It is to be noted that, in FIG. 4, reference numeral 65 represents a positioning projection, and reference character 2*e* represents legs formed on a side face of the container body 2*a*.

As shown in FIGS. 4 through 6B, the handle 2*b* includes a circular head 22 and a neck portion 2*b*2 smaller in diameter than the head 22. Centers of the head 22 and the neck portion 2*b*2 are aligned with a center axis L (shown in FIG. 5A) of the container body 2*a*. The neck portion 2*b*2 is perpendicular to the edge face 2*d* of the toner container 2 and fixed on the edge face 2*d*. A center portion of the head 22 is connected to a tip of the neck portion 2*b*2.

The head 22 includes a thin, cylindrical outer ring 2*b*1 at the rim and a thin, cylindrical inner ring 2*b*4 inside the outer ring 2*b*1. The diameter of the outer ring 2*b*1 is about 60% of the diameter of the container body 2*a*. The outer ring 2*b*1 and the inner ring 2*b*4 are concentric with each other. The head 22 further includes multiple spokes 2*b*3 arranged radially. Each spoke 2*b*3 extends radially from the center portion of the head 22 to an inner circumferential surface of the outer ring 2*b*1 across the inner ring 2*b*4.

It is to be noted that, in FIG. 5A, reference numerals 63 and 65 represents a recessed surface and a flat portion of the outer ring 2*b*1 of the handle 2*b*.

Figure 5B:
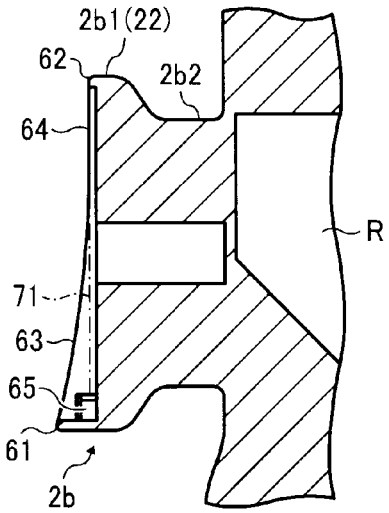
FIG. 5B is a cross-sectional view of a handle of the toner container according to the embodiment.

The outer ring 2*b*1 includes a higher point (wider point) 61 projecting to the front side of the apparatus when the toner container 2 is in the apparatus body. As shown in FIGS. 5A and 5B, the higher point 61 is positioned in a lower portion of the toner container 2 positioned horizontally with the toner supply device 2*c* (opening) faced down. The front edge of the handle 2*b* is farthest from the edge face 2*d* of the toner container 2 at the higher point 61. Additionally, a lower point (narrower point) 62 is formed in an upper portion of the outer ring 2*b*1. The front edge of the handle 2*b* is closest to the edge face 2*d* of the toner container 2 at the lower point 62. As shown in FIG. 5A, the periphery of the outer ring 2*b*1 is gradually curved inward from the higher point 61 to the lower point 62 when viewed from a side.

The above-described shape of the handle 2*b* makes it difficult to put the toner container 2 vertically with the handle 2*b* faced down on the floor or table because the front side of the handle 2*b* of the toner container 2 is thus inclined. Specifically, with the higher point (wider point) 61 and the lower point (narrower point) 61, the front face of the handle 2*b* (head 22) is inclined from a vertical line. In other words, the front face is inclined relative to the axial line L of the container body 2*a*. Accordingly, in replacement of the toner container 2, the user or service person can recognize that the toner container 2 cannot be placed vertically with the handle 2*b* on the bottom.

The gradual inward curve of the handle 2*b* is described in further detail below with reference to FIGS. 6A and 6B.

Figure 6B:
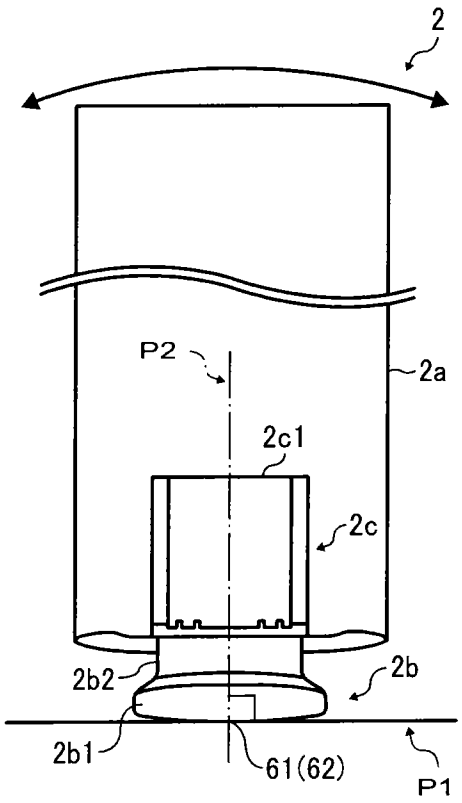
FIGS. 6A and 6B are respectively a side view and a front view of the toner container according to the embodiment placed vertically on a horizontal plane.
Figure 6A:
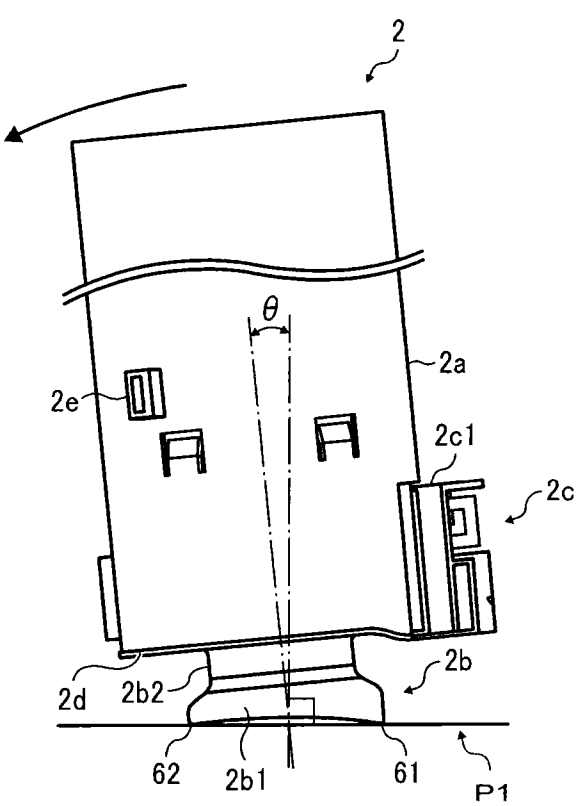

In FIGS. 6A and 6B, reference character P1 represents a first plane passing through the higher point 61 and the lower point 62 and including the center axis L of the toner container 2, and reference character P2 represents a second plane perpendicular to the first plane P1 and passing through the higher point 61 and the lower point 62. The periphery of the outer ring 2*b*1 from the higher point 61 to the lower point 62 is recessed from the second plane P2 toward the edge face 2*d* of the toner container 2, that is, away from the second plane P2. The curvature of the inward curve of the handle 2*b*, however, is greater in an area beneath the center axis L of the container body 2*a* and adjacent to the higher point 61, thus forming the recessed surface 63 curving inward, while the curvature of the inward curve of the handle 2*b* is smaller in an area above the axial line L and adjacent to the lower point 62, thus forming a substantially flat face 64 as shown in FIGS. 5A and 5B.

Additionally, as indicated by alternate long and short dashed lines shown in FIG. 5B, a circular label 71 can be attached to a face formed by the inner ring 2*b*4 and the spoke 2*b*3 inside the outer ring 2*b*1 of the head 22 of the handle 2*b*. Thus, the front face of the head 22 includes a label attachment portion. For example, the color of the toner contained in the toner container 2, type, or model number of the toner container 2 can be indicated on the label 71. The size of the label 71 can be flexibly determined to make it easy for users to recognize indications thereon because the front side of the head 22 can have a relatively large area.

Herein, it may be difficult to place the label 71 in a predetermined direction because both the label 71 and the head 22 are circular. Therefore, the positioning projection 65 can be provided as a positioning mark at a tip of the spoke 2*b*3 adjacent to the wide position 61 of the outer ring 2*b*1 to indicate a proper direction of the label 71 and prevent the label 71 from being placed upside down. With a lowest portion of the label 71 aligned with the positioning projection 65, the label 71 can be attached to the toner container 2 without deviation. It is to be noted that reference character R shown in FIG. 5B represents a toner containing compartment in the container body 2*a*.

[Replacement of Toner Containers]

Referring to FIG. 5A, in replacement of the toner container 2, the user can put his/her finger on the handle 2*b* to push in or pull out the toner container 2 from the apparatus body. At that time, the user naturally interposes the higher point 61 of the head 22 between his/her thumb and index finger (first finger), and thus insertion and removal of the toner container 2 can be facilitated.

The user can temporarily place the toner container 2 removed from the apparatus on an adjacent floor, table, or the like, and inserts a new (unused) toner container 2 into the apparatus. At that time, it is preferable that the removed toner container 2 be placed horizontally with the toner supply device 2*c* on the upper side when there is a sufficient area. As shown in FIG. 4, multiple legs 2*e* are formed on a side face of the container body 2*a* that is on the upper side in FIG. 4. That is, the legs 2*e* are on the side opposite the toner supply device 2*c*. When the toner container 2 is placed horizontally, upside down, with the legs 2*e* on the bottom, leakage of toner therefrom can be prevented because the toner supply device 2*c* is on the upper side. If the area is not sufficient, the user can place the toner container 2 vertically with the handle 2*b* on the upper side. In this case, scattering of toner from the opening 2*c*1 can be reduced or prevented because the toner supply device 2*c* is positioned on the upper side.

By contrast, referring to FIGS. 6A and 6B, if the user mistakenly places the toner container 2 with the handle 2*b* on the bottom, it is possible that the toner container 2 falls, causing leakage of toner from the opening 2*c*1 of the toner supply device 2*c* depending on the direction in which the toner container 2 falls.

In view of the foregoing, the toner container 2 is designed to tilt by an angle θ from a vertical line when being placed with the handle 2*b* on the bottom. Accordingly, the user can immediately recognize that the toner container 2 is in a wrong direction, that is, the handle 2*b* is positioned on the bottom. The angle θ can be set flexibly, for example, within a range of 5° to 10°, by changing the height of the higher point 61 and the lower point 62 of the handle (i.e., width of the outer ring 2*b*1) so as to attain a desired falling property of the toner container 2 in accordance with the center of gravity thereof. Therefore, at the vertical positions shown in FIGS. 6A and 6B, the toner container 2 cannot stand stably by itself. The unstable toner container 2 cannot hold the position but swings laterally, for example. Thus, the user can immediately recognize that the position of the toner container 2 is improper.

Figure 7A:
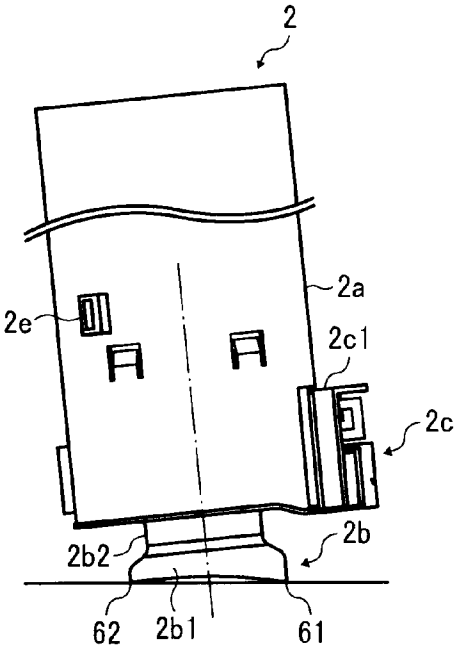
FIGS. 7A, 7B, and 7C are side views illustrating falling properties of the toner container.
Figure 7B:
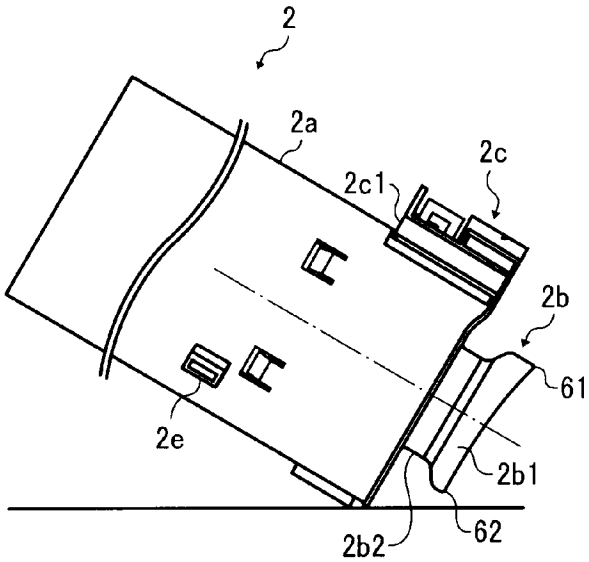
Figure 7C:
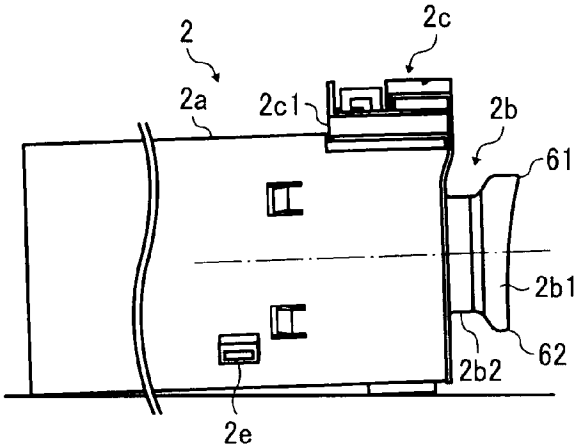

Additionally, in the present embodiment, the toner container 2 is designed not to fall to the side of the toner supply device 2*c* with the toner supply device 2*c* faced down even if the user ignores or does not notice the unstable state of the toner container 2. Specifically, the toner supply device 2*c* is on the same side as the higher point 61 of the handle 2*b*. In the present embodiment, the toner container 2 is likely to fall in the direction in which the toner container 2 is inclined by the angle θ (shown in FIG. 6A), that is, to the side of the lower point 62 of the handle 2*b*. Even if the toner container 2 falls with the lower point 62 as a fulcrum as shown in FIGS. 7A and 7B, the toner container 2 lies horizontally with the toner supply device 2*c* faced up as shown in FIG. 7C.

Specifically, the front rim of the handle 22 approaches the front edge of the container body 2*a* from the higher point 61 toward the lower point 62. Therefore, when the toner container 2 is placed with the handle 2*b* on the bottom, the toner container 2 tends to fall to the side of the lower point 62. If not fall to the side of the lower point 62, the toner container 2 has such a falling property that the toner container 2 falls in the lateral direction with the straight line passing through the higher point 61 and the lower point 62 serving as a fulcrum. Accordingly, scattering of toner from the opening 2*c*1 of the toner supply device 2*c* can be prevented or reduced.

Figure 8A:
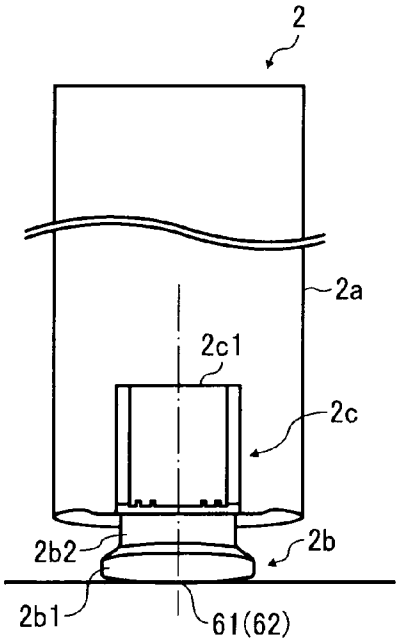
FIGS. 8A, 8B, and 8C are front views illustrating falling properties of the toner container.
Figure 8B:
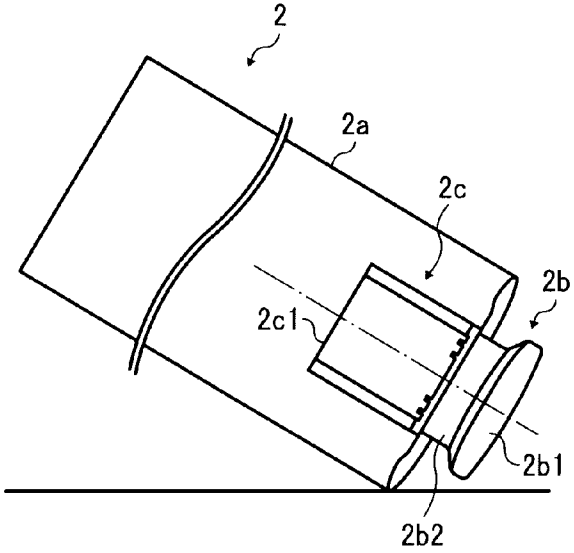
Figure 8C:
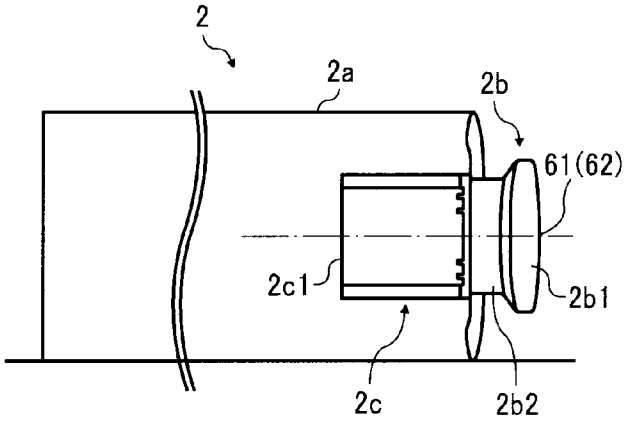

Further, even if the toner container 2 falls laterally as indicated by arrow shown in FIG. 6B, the toner supply device 2*c* comes on a side not on the bottom as shown in FIG. 8C, thus reducing the possibility of scattering of toner from the opening 2*c*1 of the toner supply device 2*c*.

As described above, in the present embodiment, the face of the handle 2*b* on the front side is inclined relative to the center axis L of the toner container 2 so that the toner container 2 is inclined and unstable when the toner container 2 is placed vertically with the handle 2*b* faced down, thereby preventing the user from placing the toner container 2 in that direction. Further, a part of the handle 2*b* is recessed, in particular, curving inward, making it easier for the user to hook his/her finger on the handle 2*b*. Thus, operability of the toner container 2 can be enhanced.

It is to be noted that, although the description above concerns configurations in which the container body 2*a* of the toner container 2 is cylindrical, alternatively, the container body 2*a* can be shaped like, for example, a prism or rectangular parallelepiped. What is contained in the container 2 is not limited to unused toner but can be waste toner or any other powder.

Numerous additional modifications and variations are possible in light of the above teachings. It is therefore to be understood that, within the scope of the appended claims, the disclosure of this patent specification may be practiced otherwise than as specifically described herein.

What is claimed is:

1. A toner container for containing toner, removably installable into an apparatus body, the toner container comprising:

a container body, a length of the toner container being arranged along a longitudinal direction, the toner container having a front and a rear, the front and the rear being opposite to each other along the longitudinal direction;

an opening for receiving toner therein or discharging toner; and a handle at the front of the toner container, the handle having a center which faces in a direction which is parallel to a center axis of the container body, the handle having an outer surface which extends away from the container body in the longitudinal direction asymmetrically with regard to the center of the handle so that a portion of the outer surface on one side of the center extends farther away from the container body than another portion of the outer surface on another side of the center which is opposite to said one side, wherein the container body includes sides which are parallel to the center axis of the container body.

2. The toner container according to claim 1, wherein the opening is at the front of the toner container.

3. The toner container according to claim 1, wherein the container body includes a cylindrical shape in the form of a round column.

4. The toner container according to claim 1, wherein the opening is perpendicular to the front of the toner container.

5. A toner container for containing toner, removably installable into an apparatus body, the toner container comprising:

a container body, a length of the toner container being arranged along a longitudinal direction, the toner container having a front side and a rear side, the front side and the rear side being opposite to each other along the longitudinal direction;

an opening for receiving toner therein or discharging toner therefrom; and a handle at the front side of the toner container, the handle having a center which faces in a direction which is parallel to a center axis of the container body, wherein the handle comprises a neck portion projecting from a front face of the container body in a direction of the center axis of the container body, and a head connected to the neck portion, a circumferential rim of the head includes a higher point where the head is farthest from the front face of the container body and a lower point where the head is closest to the front face of the container body, the lower point positioned on an opposite side from the higher point, the opening is positioned on a side face of the toner container and adjacent to the higher point of the head of the handle, and when the toner container is placed on a flat plane with the handle faced down, the toner container falls to a side except the side on which the opening is positioned.

6. The toner container according to claim 5, wherein:

a portion of the circumferential rim of the head from the higher point to the lower point is recessed toward the neck portion of the handle.

7. The toner container according to claim 5, wherein the front face of the head of the handle comprises a surface curving inward adjacent to the higher point of the head.

8. The toner container according to claim 5, wherein the front face of the head of the handle comprises a label attachment portion to which a label is attachable.

9. The toner container according to claim 5, wherein the head of the handle is greater in diameter than the neck portion of the handle.

10. The toner container according to claim 5, wherein the opening is at the front side of the toner container.

11. The toner container according to claim 5, wherein the container body includes a cylindrical shape in the form of a round column.

12. The toner container according to claim 5, wherein the opening is perpendicular to the front side of the toner container.

13. An image forming apparatus, comprising:

an image bearer;

an image forming unit to form a toner image on the image bearer; and a toner container for containing toner, removably installable into an apparatus body of the image forming apparatus, the toner container including:

a container body, a length of the toner container being arranged along a longitudinal direction, the toner container having a front and a rear, the front and the rear being opposite to each other along the longitudinal direction;

an opening of the toner container for receiving toner therein or discharging toner therefrom; and a handle at the front of the toner container, the handle having a center which faces in a direction which is parallel to a center axis of the container body, the handle having an outer surface which extends away from the container body in the longitudinal direction asymmetrically with regard to the center of the handle so that a portion of the outer surface on one side of the center extends farther away from the container body than another portion of the outer surface on another side of the center which is opposite to said one side, the toner container disposed within the image forming apparatus such that the front of the toner container is closer to a point of entry of the toner container into the image forming apparatus than the rear of the toner container, wherein the container includes sides which are parallel to the center axis of the container body.

14. The image forming apparatus according to claim 13, wherein the opening is at the front of the toner container.

15. The image forming apparatus according to claim 13, wherein the container body includes a cylindrical shape in the form of a round column.

16. The image forming apparatus according to claim 13, wherein the opening is perpendicular to the front of the toner container.

* * * * *